United States Patent [19]

Doyle

[11] 3,960,377

[45] June 1, 1976

[54] GAME APPARATUS

[76] Inventor: Natividad F. Doyle, 6202 E. 150th St., Grandview, Mo. 64030

[22] Filed: June 4, 1975

[21] Appl. No.: 583,625

[52] U.S. Cl. ..... 273/1 R
[51] Int. Cl.[2] ..... A63F 9/00
[58] Field of Search ..... 46/1 R; 150/48; 272/1 A; 273/1 R

[56] References Cited

UNITED STATES PATENTS 1,865,810 7/1932 Albach ..... 272/1 A

FOREIGN PATENTS OR APPLICATIONS 689,475 3/1953 United Kingdom ..... 150/48

*Primary Examiner*—Paul E. Shapiro
*Attorney, Agent, or Firm*—Fishburn, Gold & Litman

[57] ABSTRACT

A game apparatus used for competitive scoring by at least two players includes granular material, such as sand, corn, wheat, rice, and the like, arranged in a pile or body in depth. The players alternately position respective game pieces in the form of elongated members that are resilient or have resilient portions under the surface of the quantity of granular material by holding opposite end portions thereof, stretching same, inserting the stretched game pieces into the granular material, and releasing the opposite end portions of the respective game pieces. The players then alternately attempt to withdraw or retrieve the game pieces by inserting one end of a respective retrieving member into the granular material and into engagement with one of the game pieces and withdrawing the retrieving member all in a single pass through the granular material.

4 Claims, 7 Drawing Figures

GAME APPARATUS

The present invention relates to a game apparatus used for competitive scoring by at least two players and more particularly to a game apparatus wherein players alternately position elongated game pieces that are resilient or have resilient portions into a body or quantity in depth of granular material and then alternately attempt to remove same by means of respective retrieving members inserted into the granular material and moved into engagement with respective game pieces during one pass through the granular material.

The principal objects of the present invention are: to provide a game apparatus wherein a method of playing thereof is competitive and requires manual dexterity, finesse, and judgment; to provide such a game apparatus having appeal to all ages, including children and adults playing competitively; to provide such a game apparatus and method of playing which is simple and entertaining and wherein the game requires a degree of skill and contains elements of surprise and suspense with scoring to add play value; to provide such a game apparatus and method of playing which is unusually engrossing and requires concentration on the part of players; to provide such a game apparatus and method of playing wherein players alternately position elongated game pieces that are resilient or have resilient portions into a quantity in depth of granular material and then alternately attempt to remove same by means of respective retrieving members inserted into the granular material and moved into engagement with respective game pieces during one pass through the granular material; and to provide such a game apparatus which is economical to manufacture, formed of durable components, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the game device and method of playing same.

Figure 1:
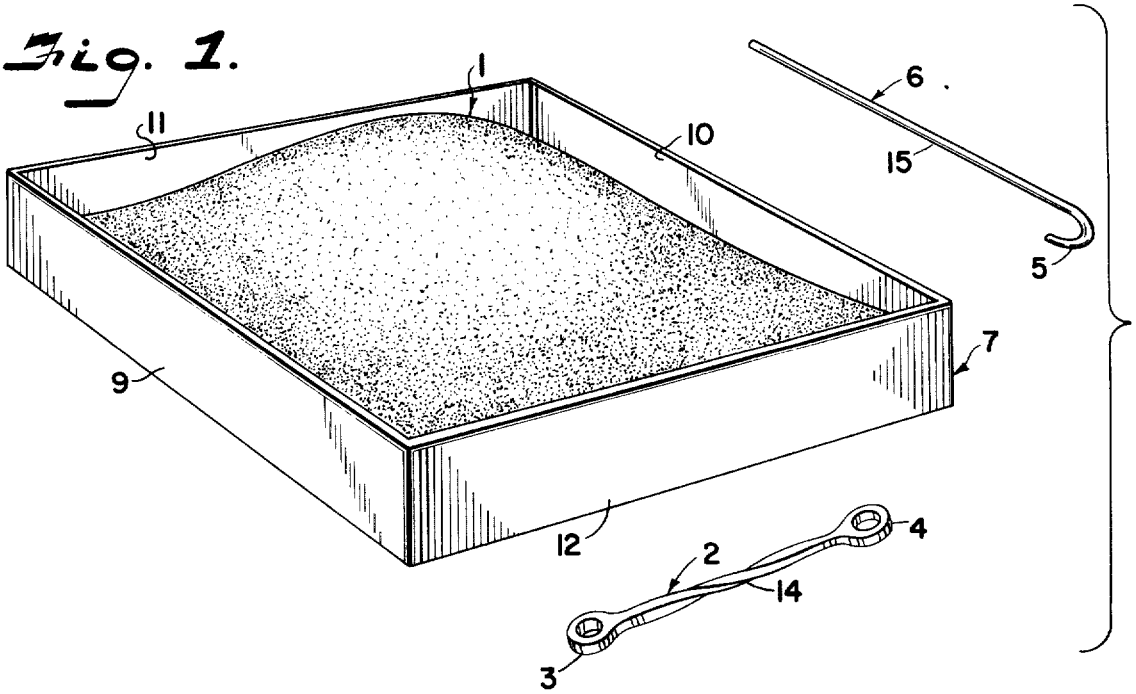
FIG. 1 is a perspective view of components of a game apparatus embodying features of the present invention.
Figure 2:
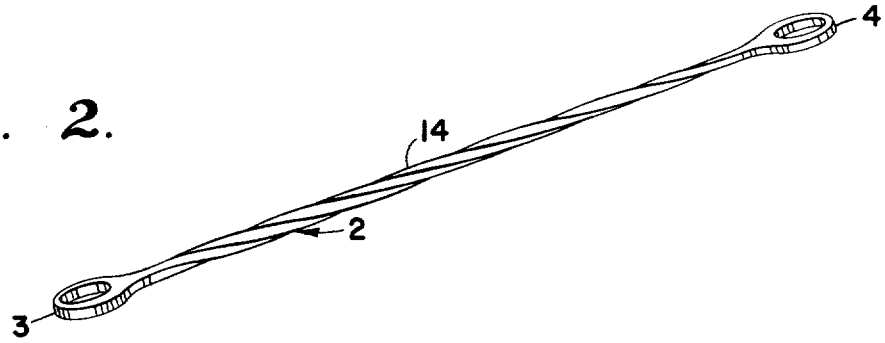
FIG. 2 is a perspective view of a game piece shown in a stretched condition.
Figure 3:
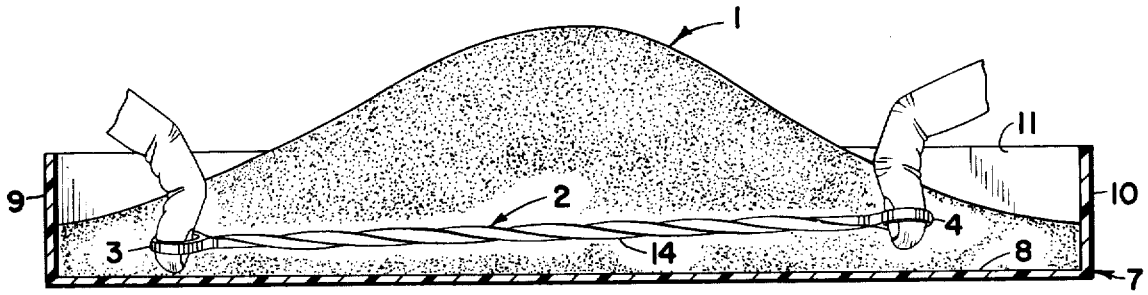
FIG. 3 is a sectional view through a quantity in depth of granular material and showing the stretched game piece therein.
Figure 4:
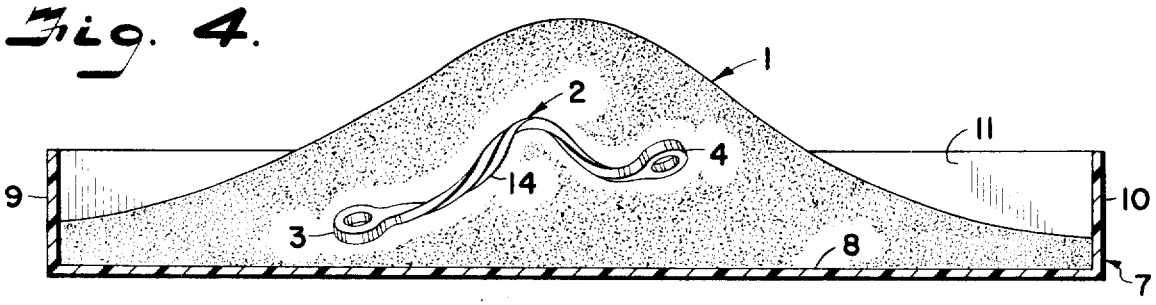
FIG. 4 is a sectional view through the pile of granular material and showing the game piece after release thereof.
Figure 5:
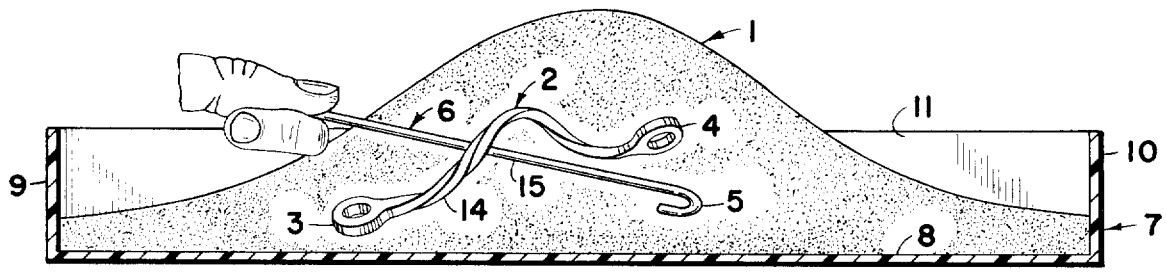
FIG. 5 is a sectional view through the granular material and showing a retrieving member inserted thereinto.
Figure 6:
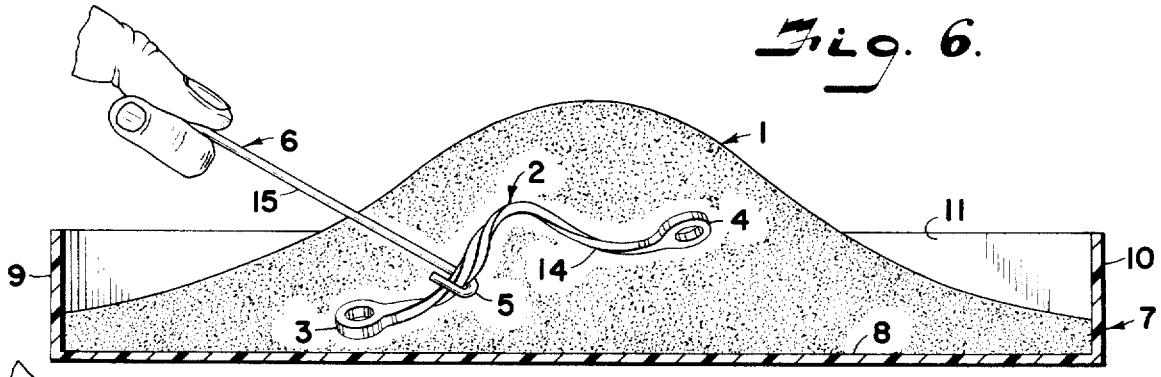
FIG. 6 is a sectional view through the granular material and showing the retrieving member in engagement with the game piece.
Figure 7:
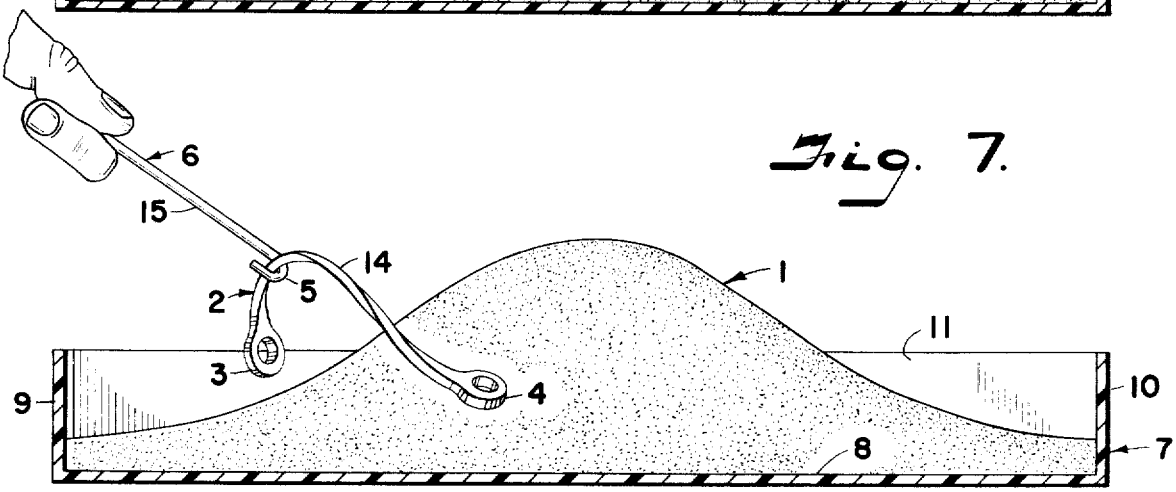
FIG. 7 is a sectional view through the granular material and showing the retrieving member and game piece after removal from the granular material.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

A game apparatus used for competitive scoring by at least two players includes granular material 1, such as sand, corn, wheat, rice, and the like, arranged in a pile or quantity in depth. The players alternately position respective game pieces in the form of elongated members 2 that have resiliency at least in a portion thereof in said granular material 1 by holding opposite end portions 3 and 4 thereof, stretching the members 2, inserting the stretched member 2 into the granular material 1 and releasing the opposite end portions 3 and 4 of the respective game piece 2. The players then alternately attempt to withdraw or retrieve the game piece 2 by inserting one end 5 of respective retrieving members 6 into the granular material 1 and into engagement with one of the game pieces 2 and withdrawing the retrieving member 6 all in a single pass through the granular material 1.

The granular material 1 may be any suitable material adapted to permit insertion of the game pieces 2 and then insertion of the retrieving members 6 thereinto. Granular materials suitable for the game device include sand, gravel, corn, wheat, rice, and the like.

The granular material 1 may be placed on any suitable surface, such as a floor, desk, table, and the like, and arranged in a pile thereon or the granular material 1 may be placed in a container 7 having a bottom wall 8 and side walls 9 and 10 and end walls 11 and 12 extending upwardly from the bottom wall 8 thereby defining an open-top container for the granular material 1 which in either case provides a quantity in depth of said granular material.

The opposite end portions 3 and 4 of the game pieces 2 are adapted to be held by a player during insertion thereof into and under the surface of the quantity of granular material 1. The game pieces 2 each are adapted to move within the granular material 1 upon release of at least one of the opposite ends thereof by respective players to thereby position same in and under the surface of granular material at a hidden location or position by respective players. The illustrated game piece 2 has the opposite end portions 3 and 4 formed as loops each adapted to receive therein a respective finger of a player. The game pieces 2 illustrated each include an intermediate portion 14 extending between the opposite end portions 3 and 4 thereof. The intermediate portion 14 is illustrated as a generally square shaft which is twisted whereby the intermediate portion 14 may be further twisted in either direction by a player prior to being inserted into the granular material 1 for positioning same therein.

The end portions 3 and 4 and the intermediate portion 14 of the game pieces 2 are preferably integral and formed of resilient material, such as rubber. The game pieces 2 are preferably color-coded, with each player having a different color. Retrieving a game piece 2 of an opposing player could be assigned a higher point value.

The retrieving members 6 each have the one end 5 thereof adapted to be inserted into the granular material 1 by a player and to remove one of the game pieces 2 upon engagement with one of the opposite end portions or the intermediate portion thereof during maneuvering and withdrawal of the retrieving member 6 from the granular material 1 whereby players alternately position the game pieces 2 in the granular material 1 and alternately insert a respective one of a plurality of retrieving members 6 into the granular material 1 in an attempt to remove one of the game pieces 2 upon withdrawal of the respective retrieving member 6.

The illustrated retrieving members 6 each have a shaft portion 15 with the one end 5 of the retrieving member 6 being formed to define a hook portion adapted to engage either one of the loop end portions 3 and 4 or the intermediate portion 14 of the respective one of the game pieces 2 in the granular material.

In using a game apparatus constructed as illustrated and described, the granular material 1 is arranged in a pile or quantity on a suitable surface, such as a desk, table, floor, or the like, or in the container 7. The opposite end portions 3 and 4 of the respective game pieces 2 are held as by inserting respective index fingers in the loops 3 and 4 and the game piece 2 is stretched. The intermediate portion 14 may be twisted in either direction prior to being stretched. The stretched game piece 2 is inserted into the pile of granular material 1. Opposite end portions 3 and 4 are then released and in retracting the game piece moves or is propelled through the granular material to a position of rest usually spaced from the place of release thereby positioning the game piece 2 in the granular material and preferably at a position unknown to an opposing player. This may be accomplished by the manner of release of the respective game piece, such as releasing only one of the end portions, releasing both simultaneousy, or releasing one and then the other of the end portions 3 and 4. The one end 5 of a player's retrieving member 6 is then inserted into the granular material 1 in respective turns. The retrieving member 6 is maneuvered in the granular material 1 during inserting the one end 5 thereof into the granular material 1 in an attempt to move same into engagement with either the intermediate portion 14 or one of the end portions 3 and 4 of one of the game pieces 2 therein. The retrieving member 6 is withdrawn from the pile of granular material 1 and the respective game piece 2 engaged thereby all in a single pass through the granular material 1. In the event that one of the players causes any portion of one of the game pieces 2 to be exposed without completely removing same from the granular material 1 during the one player's pass through the granular material 1 then the next player has a much improved chance of completely removing the partially exposed game piece 2.

The game pieces 2 are adapted for other games, such as by being positioned on a suitable support surface, such as a desk or table top, with opposing players taking turns blowing toward the game pieces 2 in an attempt to roll or maneuver their game pieces onto the top of the game piece of an opposing player.

It is to be understood that while I have illustrated and described one form of my invention, it is not to be limited to the specific form or arrangement of parts herein described and shown.

What I claim and desire to secure by Letters Patent is:

1. A game device comprising in combination:

a. a quantity in depth of granular material:

b. a plurality of game members each having an elongated resilient intermediate portion extending between and connected to enlarged opposite end portions which are held by a player during stretching thereof to an extended condition and held in the extended condition during insertion thereof into said granular material, said game members each moving within said granular material upon release of at least one of the opposite end portions thereof to reposition same in said granular material, said intermediate portion of each of said game members being twistable in either direction by a player prior to being inserted into said granular material, said intermediate portion of each of said game members untwisting upon release to further aid in repositioning said respective game member within said granular material; and c. at least one retrieving member having one end thereof formed to define a hook for for receiving therein said intermediate portion of one of said game members, said one end being insertable into said granular material by a player to remove one of said game members upon engagement therewith during withdrawal of said retrieving member from said granular material whereby players may position said game members in said granular material and insert a respective one of said retrieving members into said granular material in an attempt to remove one of said game members upon withdrawal of said respective retrieving member, said hook being substantially U-shaped.

2. A method of playing a game comprising the steps of:

a.. arranging granular material in a pile;

b. holding opposite end portions of a respective one of a plurality of game members and stretching same;

c. inserting each stretched game member into the pile of granular material;

d. releasing the opposite end portions of the stretched game member thereby positioning same within the pile of granular material;

e. inserting one end of a respective one of a plurality of retrieving members into the pile of granular material;

f. maneuvering the respective retrieving member during inserting the one end thereof to move same into engagement with one of the game members; and g. withdrawing the retrieving member and the game member therewith.

3. A game device comprising in combination:

a. a quantity in depth of granular material;

b. a plurality of game members each having resilient portions and opposite end portions adapted to be held by a player during stretching thereof to an extended condition and held in the extended condition during insertion thereof into said granular material, said game members each moving within said granular material upon release of at least one of the opposite end portions thereof to reposition same in said granular material, said opposite end portions of each of said game members comprising a loop adapted to receive therein a finger of a player, each of said game members having an intermediate portion extending between the opposite end portions thereof and being adapted to be twisted in either direction by a player prior to being inserted into said granular material, said intermediate portion of each of said game members untwisting upon release to further aid in repositioning said respective game member; and c. a plurality of retrieving members each having one end thereof adapted to be inserted into said granular material by a player and to remove one of said game members upon engagement therewith during withdrawal of said respective retrieving member from said granular material whereby players alternately in turn position said game members in said granular material and alternately in turn insert a respective one of said retrieving members into said granular material in an attempt to remove one of said game members upon withdrawal of said respective retrieving member, said retrieving members each having one end thereof formed to define a hook portion adapted to engage a portion of a respective one of said game members, said hook portion being substantially U-shaped.

4. A game device as set forth in claim 3 including a container having a bottom wall and side walls extending upwardly from said bottom wall to define an open top container for said granular material.

* * * * *